US005277634A

United States Patent [19]

Calamia et al.

[11] Patent Number: 5,277,634

[45] Date of Patent: Jan. 11, 1994

[54] LOWER UNIT TORPEDO CONFIGURATION

[75] Inventors: David C. Calamia, Grayslake; Erick L. Gruber, Waukegan, both of Ill.

[73] Assignee: Outboard Marine Corporation, Waukegan, Ill.

[21] Appl. No.: 945,821

[22] Filed: Sep. 15, 1992

[51] Int. Cl.[5] ..... B63H 21/26

[52] U.S. Cl. ..... 440/78; 440/66

[58] Field of Search ..... 440/76, 78, 900, 66

[56] References Cited

U.S. PATENT DOCUMENTS

| | | | |
|---|---|---|---|
| 1,649,657 | 11/1927 | Blake . | |
| 2,089,366 | 10/1937 | Hansen | 115/17 |
| 3,554,665 | 1/1971 | Lorenz et al. | 416/93 |
| 3,727,574 | 4/1973 | Bagge | 115/34 R |
| 3,939,792 | 2/1976 | Wasenius | 114/162 |
| 3,939,795 | 2/1976 | Rocka | 115/17 |
| 4,080,099 | 3/1978 | Snyder | 416/146 R |
| 4,096,819 | 6/1978 | Evinrude | 115/17 |
| 4,295,835 | 10/1981 | Mapes et al. | 440/900 |
| 4,447,214 | 5/1984 | Henrich | 440/66 |
| 4,898,553 | 2/1990 | Bankstahl | 440/76 |
| 4,911,665 | 3/1990 | Hetzel | 440/89 |

*Primary Examiner*—Sherman Basinger

*Attorney, Agent, or Firm*—Michael, Best & Friedrich

[57] ABSTRACT

Disclosed herein is a lower unit for a marine propulsion device, such as an outboard motor or a stern drive unit, which lower unit comprising a gear case including a torpedo having a fore and aft axis and including a forward portion, a central portion extending rearwardly from the forward portion and having a generally cylindrical configuration concentric with the axis and defined by a radius, and an aft portion extending rearwardly from the central portion and including a circumferentially extending cylindrical sub-portion which is concentric with the axis, and which is defined by the radius, and a circumferentially extending conical sub-portion which is concentric with the axis, which extends for a circumferential length of not more than 180°, and which is defined by radii which are greater than the radius and which gradually increase in the direction toward the aft end.

10 Claims, 1 Drawing Sheet

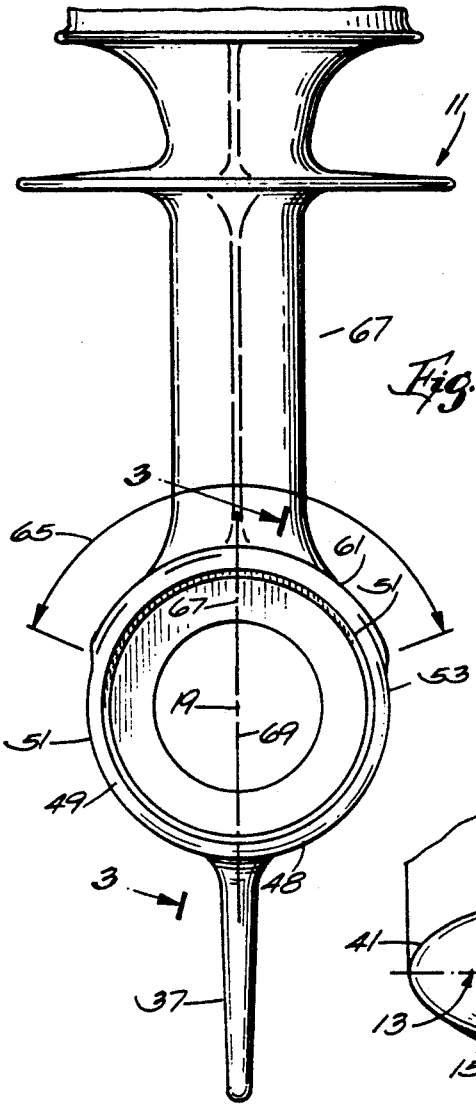
Fig. 2.
Fig. 1
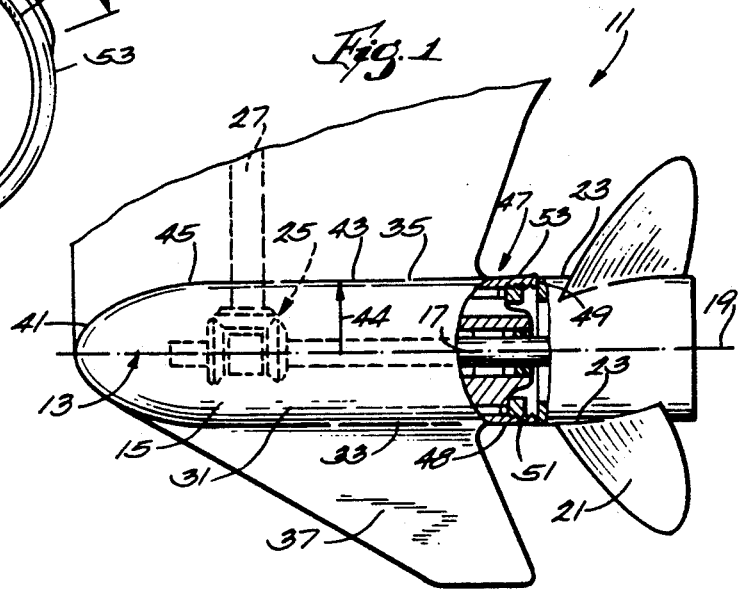
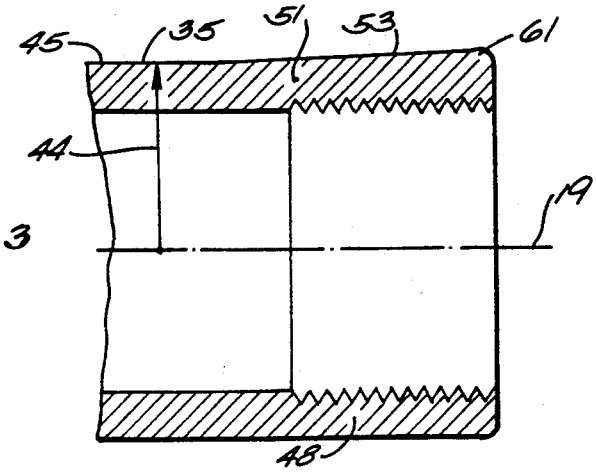
Fig. 3

LOWER UNIT TORPEDO CONFIGURATION

BACKGROUND OF THE INVENTION

The invention relates generally to lower or drive units of marine propulsion devices, such as outboard motors and stern drive units. Still more particularly, the invention relates generally to gear cases incorporated in such lower units and to the shapes or configurations of such gear cases. Still further in addition, the invention relates to shapes or configurations which are intended to affect the operation of such marine propulsion devices and which affect the back pressure in the exhaust gas discharge passage in through the hub exhaust gas systems in stern drive and outboard motors.

Attention is directed to the following U.S. Pat. Nos.:.

| | | |
|---|---|---|
| 3,554,665 | Lorenz, et al. | January 12, 1971 |
| 3,727,574 | Bagge | April 17, 1973 |
| 3,939,792 | Wasenius | February 24, 1976 |
| 3,939,795 | Rocka | February 24, 1976 |
| 4,080,099 | Snyder | March 21, 1978 |
| 4,096,819 | Evinrude | June 27, 1978 |
| 4,295,835 | Mapes, et al. | October 20, 1981 |
| 4,447,214 | Henrich | May 8, 1984 |
| 4,898,553 | Bankstahl | February 6, 1990 |
| 4,911,665 | Hetzel | March 27, 1990 |

With respect to the above patents, attention is particularly directed to FIG. 5 of U.S. Pat. No. 4,295,835.

SUMMARY OF THE INVENTION

The invention provides a lower unit for a marine propulsion device, such as an outboard motor or a stern drive unit, which lower unit comprising a gear case including a torpedo having a fore and aft axis and including a forward portion, a central portion extending rearwardly from the forward portion and having a generally cylindrical configuration concentric with the axis and defined by a radius, and an aft portion extending rearwardly from the central portion and including a circumferentially extending cylindrical sub-portion which is concentric with the axis, and which is defined by the radius, and a circumferentially extending conical sub-portion which is concentric with the axis, which extends for a circumferential length of not more than 180°, and which is defined by radii which are greater than the radius and which gradually increase in the direction toward the aft end.

Other features of and advantages of the invention will become apparent to those skilled in the art upon review of the following detailed description, claims, and drawings.

IN THE DRAWINGS

FIG. 1 is a fragmentary side elevational view of a lower unit forming a part of a marine propulsion device.

FIG. 2 is an enlarged rear view of the lower unit shown in FIG. 1.

FIG. 3 is an enlarged fragmentary sectional view taken along line 3—3 of FIG. 2.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways.

Also, it is to be understood that the phraseology and terminology used herein is for the purpose of description and should not be regarded as limiting.

GENERAL DESCRIPTION

Shown in FIG. 1 is a lower unit 11 which is part of a marine propulsion device (not otherwise shown), such as an outboard motor or a stern drive unit. The lower unit 11 includes a strut or drive shaft housing 13 having, at the lower end thereof, a gear case 15 which centrally supports a propeller shaft 17 extending along a fore-and-aft axis 19. Carried on the propeller shaft 17, aft of the gear case 15, is a propeller 21 which is preferably of the type including an outer hub through which exhaust gas is discharged. The outer hub preferably has a cylindrical outer surface 23. Propellers which do not discharge exhaust gas through the hub can also be employed.

The propeller shaft 17 is driven through a transmission 25 from a drive shaft 27 which is journaled in the lower unit 11 and which, in turn, is driven by an internal combustion engine (not shown). The drive shaft housing 13, the gear case 15, and the propeller 21 are all interiorly configured to provide through the (propeller) hub exhaust gas discharge, which arrangement is well known in the art, one example of which is disclosed in U.S. Pat. No. 3,554,665 issued Jan. 12, 1971, and incorporated herein by reference.

The gear case 15 comprises a bullet or torpedo 31 which includes an under surface 33 and an upper surface 35, and which extends generally concentrically with respect to the fore-and-aft axis 19. The gear case 15 also includes a skeg 37 which depends vertically downwardly from the undersurface 33 of the torpedo 31. Included in the torpedo 31 are a forward portion 41 which is generally coaxial with the axis 19, a central portion 43 which extends rearwardly from the forward portion 41, which has a generally cylindrical outer surface or configuration 45 concentric with the axis 19, and which is defined by a radius 44, and an aft portion 47 which extends rearwardly from the central portion, which has an aft or rearward end 49, and which includes circumferentially extending partially cylindrical sub-portion 48 which is coaxial with the axis 19 and which is defined by the radius 44, and a circumferentially extending conical sub-portion 51 having an outer surface 53 which is coaxial with the axis 19 and which is defined by radii which are greater than the radius 44 and which slightly and gradually increase in the direction toward the aft end 49. In the specifically disclosed preferred construction, the conical sub-portion extends for not more than 180° and preferably extends for about 180°. In addition, in the preferred construction, outer surface 53 extends rearwardly at an angle of 3° to the fore-and-aft axis 19. In addition, at the aft end 49, the conical sub-portion 51 also includes a projection 61 extending radially outwardly from the conical sub-portion 51 and along the upper surface 35 for a circumferential length 65 of not more than 180°. In the disclosed preferred construction the circumferential length 65 is about 160°.

While other specific configurations can be employed, in the disclosed preferred construction, the projection 61 has a semi-cylindrical shape in a plane 67 extending radially and axially from the fore-and-aft axis 19 and projects radially outwardly beyond the conical configuration 51 at the rearward end 49 of the aft portion 41. In the disclosed preferred construction, the projection 61 has a radius of ¾ of an inch and extends for about 80° on both sides of a vertical plane 69 extending radially and axially from the fore-and-aft axis 19. The projection 61 serves to increase local pressure on the bullet or torpedo and on the strut or drive shaft housing and initiates flow separation and/or cavition directly aft of the projection 61. This boundary layer control technique stabilizes the downstream flow condition which results in a reduction of exhaust back pressure.

The disclosed construction advantageously functions to significantly reduce the back pressure in the through-the-hub exhaust gas discharge systems employed in stern drives and outboard motor.

While the disclosed conical sub-portion is located on the top half of the torpedo 31, the conical sub-portion could be located at either side, or at the bottom, or elsewhere around the circumference of the aft portion 47.

Various of the features of the invention are set forth in the following claims.

We claim:

1. A lower unit for a marine propulsion device, said lower unit comprising a gear case including a torpedo having a fore and aft axis and including a forward portion, a central portion extending rearwardly from said forward portion and having a generally cylindrical configuration concentric with said axis and defined by a radius, and an aft portion extending rearwardly from said central portion and including a circumferentially extending cylindrical sub-portion which is concentric with said axis, and which is defined by said radius, and a circumferentially extending conical sub-portion which is concentric with said axis, which extends for a circumferential length of not more than 180°, which extends co-axially with said cylindrical sub-portion, which is defined by radii which are greater than said radius, and which gradually increases in the aft direction.

2. A lower unit in accordance with claim 1 wherein said torpedo has an upper half, and said conical portion is located in said upper half.

3. A lower unit for a marine propulsion device, said lower unit comprising a gear case including a torpedo having a fore and aft axis and including an upper half, a forward portion, a central portion extending rearwardly from said forward portion and having a generally cylindrical configuration concentric with said axis and defined by a radius, and an aft portion extending rearwardly from said central portion and including an aft end, a circumferentially extending cylindrical sub-portion which is concentric with said axis, and which is defined by said radius, a circumferentially extending conical sub-portion which is concentric with said axis, which extends for a circumferential length of not more than 180°, which is defined by radii which are greater than said radius, and which gradually increase in the direction toward said aft end, and which is located in said upper half, and a projection extending radially outwardly from said conical sub-portion at said aft end.

4. A lower unit in accordance with claim 3 wherein said projection has semi-cylindrical shape in a plane extending radially and axially from said axis.

5. A lower unit in accordance with claim 3 wherein said conical sub-portion extends for at least 80° to both sides of a vertical plane extending radially and axially from said axis, and wherein said projection has an arcuate length which extends for about 80° to both sides of said vertical plane.

6. A lower unit in accordance with claim 3 when said projection has a configuration which is generally uniform throughout said arcuate length.

7. A lower unit for a marine propulsion device, said lower unit comprising a gear case including a torpedo having a fore and aft axis and including a forward portion, a central portion extending rearwardly from said forward portion and having a generally cylindrical configuration concentric with said axis and defined by a radius, and an aft portion extending rearwardly from said central portion and including an aft end, a circumferentially extending cylindrical sub-portion which is concentric with said axis, and which is defined by said radius, a circumferentially extending conical sub-portion which is concentric with said axis, which extends for a circumferential length of not more than 180°, which is defined by radii which are greater than said radius, and which gradually increase in the direction toward said aft end, and a projection extending radially outwardly from said conical sub-portion at said aft end.

8. A lower unit in accordance with claim 7 wherein said projection has semi-cylindrical shape in a plane extending radially and axially from said axis.

9. A lower unit in accordance with claim 7 wherein said conical sub-portion extends for at least 80° to both sides of a vertical plane extending radially and axially from said axis, and wherein said projection has an arcuate length which extends for about 80° to both sides of said vertical plane.

10. A lower unit in accordance with claim 7 when said projection has a configuration which is generally uniform throughout said arcuate length.

* * * * *